United States Patent [19]

London

[11] Patent Number: 4,965,967

[45] Date of Patent: Oct. 30, 1990

[54] APPARATUS FOR LOW STRESS POLISHING OF SPHERICAL OBJECTS

[75] Inventor: Christopher L. London, San Jose, Calif.

[73] Assignee: Watkins-Johnson Company, Palo Alto, Calif.

[21] Appl. No.: 455,182

[22] Filed: Dec. 22, 1989

[51] Int. Cl.[5] ..... B24B 1/00

[52] U.S. Cl. ..... 51/289 S; 51/116; 51/128; 51/131.2

[58] Field of Search ..... 51/116, 118, 128, 129, 51/131.1, 131.2, 131.5, 163.2, 215 R, 215 AR, 215 HM, 289 R, 289 S

[56] References Cited

U.S. PATENT DOCUMENTS 3,660,942 5/1972 Messerschmidt ..... 51/289 S X 3,984,945 10/1976 Messerschmidt ..... 51/289 S X

FOREIGN PATENT DOCUMENTS 183353 7/1989 Japan ..... 51/289 S

*Primary Examiner*—James G. Smith

*Attorney, Agent, or Firm*—Flehr, Hohbach, Test, Albritton & Herbert

[57] ABSTRACT

Apparatus for polishing spherical objects includes first and second plates having smooth facing surfaces. A first plate comprises ceramic material which is rotatably supported, and the first plate includes a transparent plate. Spherical objects to be polished are placed between the two plates along with an abrasive slurry, and magnets are positioned on a top surface of the first plate to magnetically limit the path of travel of the spherical objects as the second plate is rotated. The first plate includes at least one radially concave groove in which this spherical objects are mixed during a polishing operation.

15 Claims, 2 Drawing Sheets

APPARATUS FOR LOW STRESS POLISHING OF SPHERICAL OBJECTS

BACKGROUND OF THE INVENTION

This invention relates generally to apparatus for polishing spherical objects, and more particularly the invention relates to a novel low stress apparatus for and method of polishing of such objects.

Spherical objects such as yig crystals and steel balls for ball bearings, for example, require a uniform polished surface. Yig crystals are used in microwave electronic circuits as tuning elements. Typically, a thin wafer of a yig crystal is scribed and broken to obtain a plurality of cubical dice. Corners of the dice are broken away in a tumbler, and then the dice are polished in a lapping machine to obtain a spherical configuration.

Heretofore, the dice have been placed between two plates having sandpaper surfaces, and then the plates are rotated in pressure engagement to lap the dice crystals. Actual lapping time is on the order of 38 hours, however, due to stop-start time associated with monitoring the polishing process and maintaining the polishing machine during operation, actual time for polishing a batch of yig crystals averages 23 days. Since an operator must be present during the lapping operation, a single working shift is limited to eight hours per day, with actual polishing time being on the order of five hours. The process must be periodically stopped and spheres removed from the machine to measure diameter and to remove broken or damaged spheres. Additionally, the sandpaper must be periodically changed.

The conventional polishing apparatus relies on several grades of sandpaper to accomplish the rough and fine grinding of spheres. Typically, course and fine polish are done with a unique non-woven dense polishing cloth and alumina abrasives. Brass backing plates are used to support surfaces of paper on the moving and stationary lapping surfaces, and a composite fiber material is used to form a retaining ring to prevent the spheres from ejecting from the machine due to angular acceleration.

Additionally, conventional polishing machines exert several pounds of pressure on the particles between the plates which results in a relatively high rate of stock removal. The amount of material being removed must be constant and without preference to any sector of the surface, excessive down force per unit area inhibits the sphere from rotating on a random axis as is required for spherical polishing.

Another cause of non-uniform stock removal is skidding rather than rolling, of particles between the lapping plates. This is caused by non-flatness of the lapping surfaces, and damage is exacerbated when coupled with high rotational speeds. Skidding is particularly damaging, and may have permanent effects. At the beginning of the process when particles exhibit only an approximately round shape and are prone to skidding anyway. Particles that are highly spherical are less susceptible to skidding and may tolerate higher rotational speeds without sustaining damage. The non-flatness allows spheres in process to decelerate in rotational speed as they disengage from both top and bottom surfaces. Damage occurs when the spheres re-engage the top and bottom lapping surfaces and experience very high torque loads and rates of acceleration. In effect, a sphere is not able to instantaneously accelerate to the angular surface speed of the lapping wheel and consequently skids on the lapping surface.

SUMMARY OF THE INVENTION

Accordingly, an object of the present invention is improved apparatus for polishing of spherical objects.

Another object of the invention is a method of polishing a spherical object with reduced stock removal and more uniform stock removal.

Yet another object of the invention is a method of polishing spherical objects which requires less total processing time.

A feature of the invention is the use of hard lapping plates and an abrasive slurry therebetween.

Another feature of the invention is the use of magnets to confine particles to a fixed annular polishing path between the lapping plates.

Still another feature of the invention is the use of a transparent plate so that the lapping operation can be viewed by an operator.

Another feature of the invention is the use of low stress loads (e.g. several hundred grams) on the particles during polishing.

Briefly, first and second polishing plates are positioned in space alignment with particles to be polished therebetween. The particles rotate in an abrasive slurry as the two plates are rotated relative to each other. In a preferred embodiment, a rotatable plate having a ceramic surface and a stationary glass plate are utilized. An alignment bracket engages the glass plate to maintain its stationary position as the other plate is rotated.

One or more magnets is positioned on the glass plate to define an annular path for the particles as they are rotated between the two plates. The magnets magnetically attract the particles undergoing polishing and prevent the particles from being ejected from the plates due to angular acceleration.

In accordance with another feature of the invention, at least one surface of the two plates which interfaces with the particles has a concave portion to facilitate the mixing of the particles during the polishing operation.

The invention and objects and features thereof will be more readily apparent from the following detailed description and appended claims when taken with the drawing.

DETAILED DESCRIPTION OF ILLUSTRATIVE EMBODIMENTS

Figure 1:
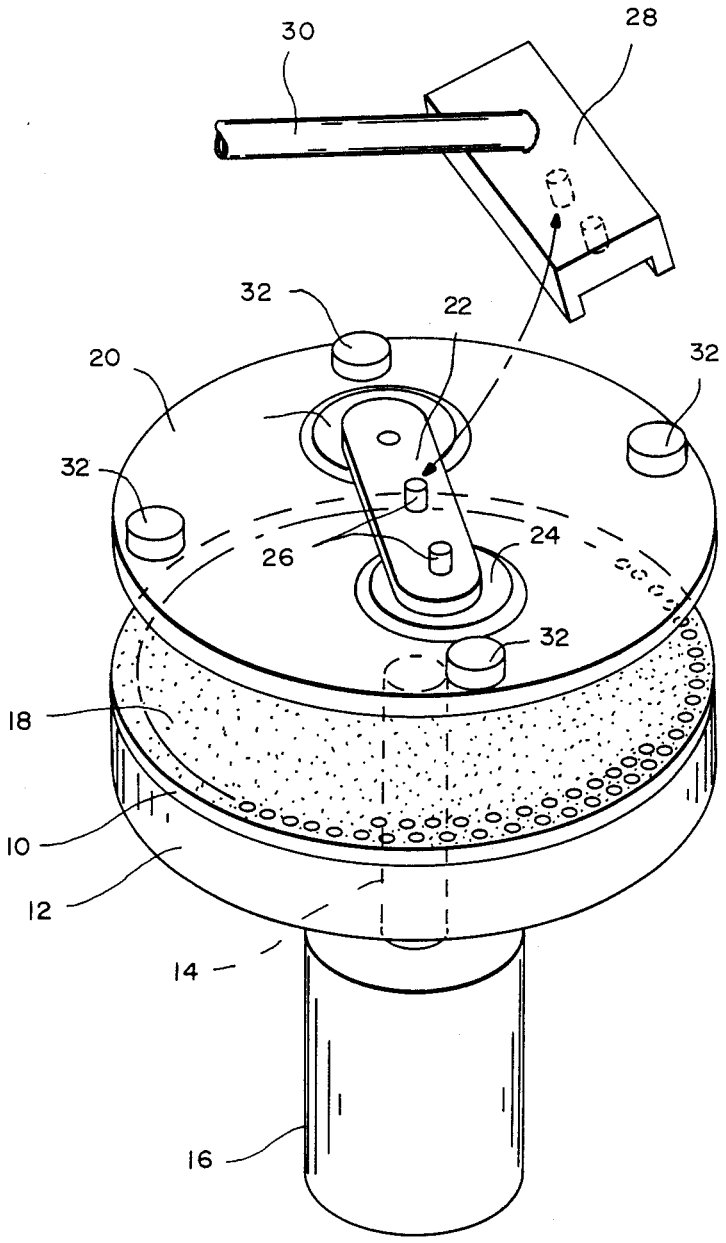
FIG. 1 is an exploded perspective view of polishing apparatus in accordance with one embodiment of the invention.
Figure 2:
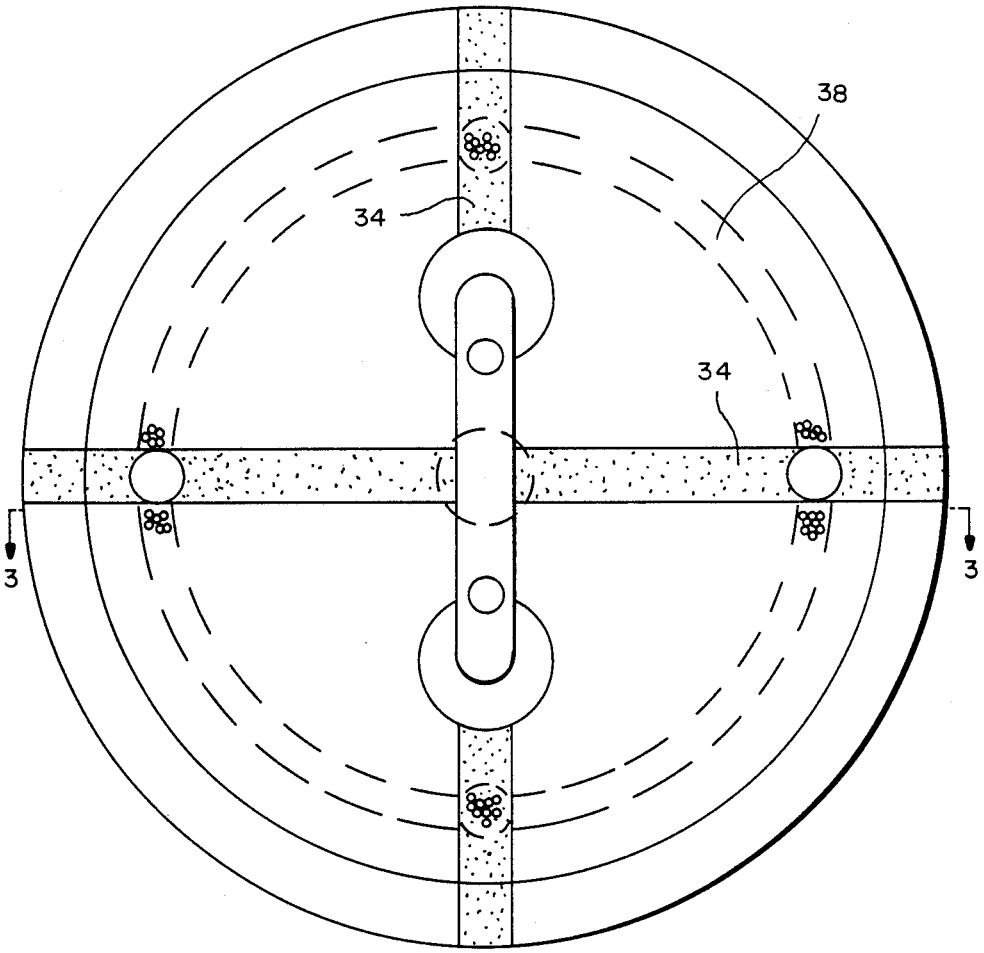
FIG. 2 is a top plan view of the apparatus of FIG. 1.
Figure 3:
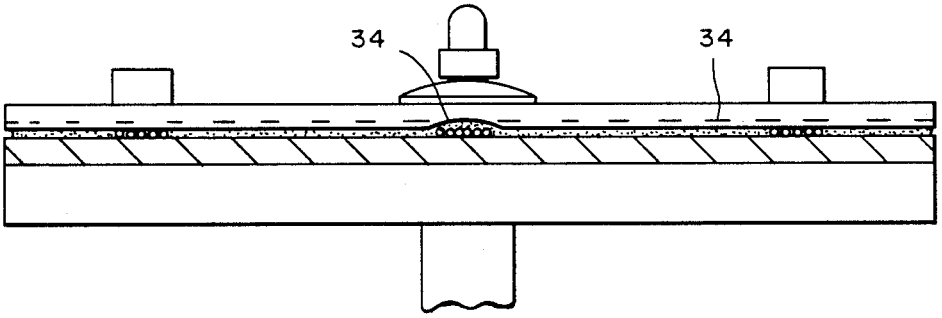
FIG. 3 is a section view of the apparatus of FIG. 1 taken through the line 3—3 of FIG. 2.

Referring now to the drawing, FIG. 1 is an exploded perspective view of polishing apparatus in accordance with one embodiment of the invention, FIG. 2 is a plan view of the apparatus, and FIG. 3 is a section view of the apparatus taken through the line 3—3 of FIG. 2. As best seen in FIG. 1, the apparatus includes a hard ceramic plate 10 which is mounted to a metal (e.g. steel) backing plate 12 by adhesive or other suitable means. The backing plate 12 and ceramic plate 10 are mounted on a shaft 14 which is rotated by motor 16. The ceramic plate 10 has a smooth polished surface 18.

Facing the ceramic plate 10 is a glass plate 20 on which is mounted an alignment bracket 22 by means of suction cups 24. The alignment bracket 22 and projections 26 extending therefrom mate with a complimentary alignment bracket 28 mounted on the end of a stationary alignment bar 30. The alignment bar 30 is pivotal so that the alignment bracket 28 can be disengaged from alignment bracket 22 for removal of the glass plate 20. During operation of the polishing apparatus, the alignment bracket 28 mates with alignment bracket 22 and the alignment bar 30 prevents the glass plate 20 from moving while the ceramic plate 10 and metal backing plate 12 are rotated.

In specific embodiments, the glass plate is one quarter inch thick and has an eight inch diameter, and the underlying ceramic plate has similar dimensions.

In accordance with one feature of the invention, magnets 32 are positioned on the top surface of glass plate 20 equal distant from the center of the plate and are provided to align particles during a polishing operation. The magnets are preferably samarium cobalt having a strength of 5,000 gauss. As shown in FIGS. 2 and 3, etched grooves 34 are formed in the surface of the glass plate 20 opposite from the magnets to facilitate the mixing of particles as they are polished.

In operation, a suitable slurry such as glycol having fine particles of diamond is provided in the space between the two plates. Particles to be polished, yig crystals for example, are provided in the slurry. A force of only a few hundred grams is imparted on the particles between the plates, and the lower plates 10, 12 are rotated at 5–60 RPM. The magnets 32 confine the yig particles to an annular path shown generally at 38 in FIG. 2 so that the particles have generally uniform polishing. The magnets also prevent the particles from being ejected from the polishing surfaces due to angular acceleration.

As noted above, the surface of glass plate 20 facing the particles has concave surface areas 34 etched therein which facilitates the tumbling and mixing of the yig particles. When influenced by the magnetic field generated at the top surface. Advantageously, the machine operator can view the particles through the glass plate 20 during processing and note any malfunctions in the apparatus. Because of the light load imparted on the particles, the apparatus can be operated 24 hours a day without the continuous presence of a human operator. In the prior art an operator is required to monitor the process and interrupt the process if breakage of particles in process occurs, as frequently happens. Otherwise the broken particles will cause a chain reaction of breakage that will destroy all remaining sound particles.

The quantity of particles polished can vary from 500 to 3,000 per polishing lot, depending on the diameter of the particles distributed uniformly in the annular zone defined by the magnets. The stationary glass plate 20 is supported solely by the spheres during polishing.

The apparatus and method in accordance with the invention removes less material from the particles than does the prior art. Typically, in prior art processing particles had to be 10–12 mils larger in diameter than the end product. However, the invention removes only 4–6 mils from the particles being polished and imparts a superior degree of sphericity.

Use of magnetic fields promotes sphere rotation around an infinite number of axis, randomly determined and redistributes the spheres randomly relative to their radius from the center of the rotating lapping wheel. This results in the overall distance traveled to be essentially equal for all spheres in the process. This greatly improves the diameter uniformity. The magnets further efficiently perform the task of restraining spheres within the polishing apparatus by opposing the angular acceleration which would otherwise eject the particles. The apparatus assures constant random motion to the particles at all times and reduces the cutting rate and renders the system more tolerant of particles whose size and morphology is divergent from the norm (e.g. larger, smaller, or non-symmetrical). Thus, the divergent particles are not broken up and eventually are transformed into spheres that conform to standards in every particular. This greatly enhances yield for 2 reasons: (1) particles are rarely broken in process, and (2) particles that would be rejected for processing with the prior art are suitable for use with the new art. The glass plate and ceramic lapping wheel are significantly flatter than lapping surfaces used in prior art processes, and the flatter surfaces coupled with very slow rotational velocities eliminates damaging skidding of the particles during polishing. The abrasive particles used in the slurry can be much smaller in size than the grit size of the sand paper previously used. The combination of smaller abrasives, less down force on the particles, reduced speed of rotation and enhanced random motion results in more uniform stock removal at a reduced rate of removal. While the time required to complete a polishing run is four times higher than the prior art, this is favorably offset by the 24 hour a day operation permitted by the new apparatus. Average time to complete a lot with the invention is 10 days versus 23 days with prior art.

The apparatus has proved particularly successful in polishing yig resonators as used in microwave applications; however the apparatus is applicable to any spherical body which must be polished. Thus, while the invention has been described with reference to a specific embodiment, the description is illustrative of the invention and is not to be construed as limiting the invention. Various modifications and applications may occur to those skilled in the art without departing from the true spirit and scope of the invention as defined by the appended claims.

What is claimed is:

1. Apparatus for polishing spherical objects comprising a first plate having a smooth surface, drive means for rotating said first plate, a second plate having a smooth surface, support means for stationarily supporting said second plate adjacent to said first plate with said smooth surfaces facing each other, and magnet means positioned on said second plate for limiting the travel of particles between said first plate and said second plate during a polishing operation.

2. Apparatus as defined by claim 1 wherein said second plate is transparent.

3. Apparatus as defined by claim 2 wherein said first plate is a ceramic.

4. Apparatus as defined by claim 3 wherein said second plate is glass.

5. Apparatus as defined by claim 4 wherein said smooth surface of said second plate has concave surfaces radially aligned therein to facilitate the mixing of particles during polishing.

6. Apparatus as defined by claim 5 wherein said magnet means is positioned above a concave surface.

7. Apparatus as defined by claim 6 wherein said magnet means includes a plurality of magnets each positioned above a concave surface.

8. Apparatus as defined by claim 1 wherein said smooth surface of said second plate has concave surfaces radially aligned therein to facilitate the mixing of particles during polishing.

9. Apparatus as defined by claim 8 wherein said magnet means is positioned above a concave surface.

10. Apparatus as defined by claim 9, wherein said magnet means includes a plurality of magnets each positioned above a concave surface.

11. Apparatus as defined by claim 1 wherein said support means comprises an alignment bracket affixed to said second plate and an alignment bar for engaging said alignment bracket.

12. Apparatus as defined by claim 1 wherein said drive means includes a backing plate in which said first plate is affixed, a drive motor having a shaft, and means for coupling said shaft to said backing plate.

13. A method of polishing spherical objects comprising the steps of placing said spherical objects and an abrasive slurry between a first stationary plate and a second rotatable plate, said first and second plates having smooth facing surfaces, placing a light load on said spherical objects, rotating said second plate, and magnetically restricting the path of travel of said spherical objects between said plates.

14. The method as defined by claim 13 wherein said first plate has at least one radially concave groove in said smooth surface, said method further including the step by mixing said particles in said groove as said second plate rotates.

15. The method as defined by claim 14 wherein said first plate is transparent, said method further including the step of visually monitoring said spherical objects as said second plate rotates.

* * * * *